US006229765B1

(12) United States Patent
Rabi

(10) Patent No.: US 6,229,765 B1
(45) Date of Patent: May 8, 2001

(54) ELECTRONIC SUNRISE-DEPENDENT TIMEPIECE

(75) Inventor: Moshe Rabi, Herzelya (IL)

(73) Assignee: RM-IC Telepathy Ltd., Herzelya (IL)

( * ) Notice: Subject to any disclaimer, the term of this patent is extended or adjusted under 35 U.S.C. 154(b) by 0 days.

(21) Appl. No.: 09/266,022

(22) Filed: Mar. 11, 1999

(30) Foreign Application Priority Data

Nov. 5, 1998 (IL) ..... 126920

(51) Int. Cl.[7] ..... G04F 5/00; G04B 19/26; G04C 9/00

(52) U.S. Cl. ..... 368/156; 368/28; 368/185; 368/187

(58) Field of Search ..... 368/185, 187, 368/28, 29, 157, 156

(56) References Cited

U.S. PATENT DOCUMENTS

| | | | | |
|---|---|---|---|---|
| 3,827,233 | | 8/1974 | Villa Eschevarria et al. . | |
| 4,671,672 | | 6/1987 | Hubner . | |
| 4,763,311 | * | 8/1988 | Marvosh | 368/157 |
| 4,920,365 | * | 4/1990 | Marx et al. | 368/187 |
| 4,956,826 | * | 9/1990 | Coyman et al. | 368/28 |
| 4,995,020 | * | 2/1991 | Mitchell | 368/185 |
| 5,926,441 | * | 7/1999 | Zinsmeyer et al. | 368/28 |
| 6,011,755 | * | 1/2000 | Mulhall et al. | 368/28 |

FOREIGN PATENT DOCUMENTS

| | | |
|---|---|---|
| 3708578 | 10/1987 | (DE) . |
| 196 53 306 | 6/1998 | (DE) . |
| 0447849 | 9/1991 | (EP) . |
| 0762244 | 3/1997 | (EP) . |

OTHER PUBLICATIONS

JP361017090A, Muroi et al., Yearly Solar Time Switch, abstract, Jan. 1986.*

* cited by examiner

*Primary Examiner*—Vit Miska
*Assistant Examiner*—Jeanne-Marguerite Goodwin
(74) *Attorney, Agent, or Firm*—Browdy and Neimark

(57) ABSTRACT

An electronic sunrise-dependent timepiece, comprising an oscillator circuit for generating clock pulses at a predetermined frequency and a clock circuit coupled to the oscillator circuit for generating minutes and hours and calendar data. An offset correction circuit coupled to the clock circuit and being responsive to a current value of calendar data adds a respective offset to the minutes and hours data so as to generate a sunrise-dependent time of day for display on a suitable display device.

4 Claims, 3 Drawing Sheets

ELECTRONIC SUNRISE-DEPENDENT TIMEPIECE

FIELD OF THE INVENTION

This invention relates to digital electronic timepieces.

BACKGROUND OF THE INVENTION

Digital watches and clocks have become so commonplace that fully integrated clock circuits are widely available requiring little more than the connection of an external battery, a display and suitable set switches to construct a fully functional timepiece. Such integrated circuits are based on a highly accurate oscillator usually employing a quartz crystal and a counter. Suitable registers are connected to the counter and have respective outputs which are adapted to toggle after a predetermined number of pulses have been counted. In this manner, stock can be taken separately of the passage of seconds, minutes and hours. Likewise, after suitable initialization, track can be taken of the successive passage of twenty-four hour periods, thus allowing calendar data also to be maintained and displayed. The outputs are converted from binary-coded decimal format for display on 7-segment displays. Usually, an alarm clock function is also provided so as to alert the user of the watch at a preset time of day, typically so as to awaken the user from sleep.

Currently available digital watches, once set by the manufacturer or user, maintain an accurate record of the time and calendar data but take no account of the small seasonal changes in sunrise time which occur in any given location. Such changes occur continuously and, unless corrected for, are cumulative over a period of time. More specifically, sunrise occurs later throughout the winter until mid-winter and occurs earlier throughout the summer until mid-summer.

The cumulative change in sunrise time, over a period of time, results in an increasing seasonal discrepancy between the time of sunrise and the time a person must start the day. This is unpleasant because most people prefer to rise when it starts to get light outside. Thus, if this requirement is met at the start of winter, then owing to the increasing delay in time of sunrise throughout winter until the onset of mid-winter, people who rise at the same time each day will be constrained to do so when it is increasingly dark outside. On the other hand, in summer people tend naturally to awaken earlier than necessary owing to the increasing advance in time of sunrise throughout summer.

In many countries it is common to make a one-off correction for the cumulative delay and advance in sunrise time by "moving the clock" forward in summer and backward in winter, usually by one hour at a given time on a specified day at the start of summer and winter. Obviously, any day may be specified as to when the necessary correction or corrections should be made and this is usually determined by each government in an effort to make maximum use of available daylight, thereby reducing the need for artificial illumination and thereby saving energy. Such considerations may encourage seasonal corrections to be made more than once each season.

Regardless of how many times a season correction is made, it frequently plays havoc with the internal bio-clock of the workforce. The reason for this is obvious when the clock is moved forward in summer, because the adjustment is normally effected at midnight or in the middle of the night causing people to lose an hour's sleep. However, in the winter the adjustment is no less convenient for two reasons. First, people normally go to bed an hour later since they know that nominally they will have the same number of hours'sleep. Thus, at best, they receive no benefit from the hour gained. Usually, however, their body wakens at the normal time to which they have become accustomed which is now an hour earlier than necessary. So they lose on both counts and suffer from tiredness until their bodies become accustomed to the new regimen.

This inability to adjust to a sudden change in nominal time is due to the fact that, in order to be effective, a large increment of at least one hour, must either be added or subtracted from the nominal time once each season. The actual change in time of sunrise is, of course, much more gradual but it is not very practical to make many small adjustments throughout each season.

In addition to time changes caused by seasonal effects, it is also known that sunrise changes with longitude and this gives rise to geographic-dependent time changes according to one's longitude. Here, too, each adjacent time zone has a time difference of one hour, either plus or minus depending on the relative longitude of the adjacent zones. People who travel from one time zone to another must set their watches accordingly and the cumulative time difference in travelling between remote zones, and thereby crossing many intermediate time zones results in the phenomenon well-known as "jet lag" with its attendant exhaustion.

Whilst there is no way to compensate for jet lag, the patent literature has addressed the need to adjust one's watch when crossing adjacent geographic time zones. Thus, U.S. Pat. No. 3,827,233 in the name of Villar discloses a mechanical geographic timepiece wherein the minute hand is rotated, via a worm and bevel gear system in accordance with the inclination of the polar axis of the earth. This allows for automatic compensation for changing longitude as the timepiece is transported through different time zones.

U.S. Pat. No. 4,671,672 to Hubner discloses a universal time clock employing a globe which is driven by the hour tube of a left-hand rotating clockwork.

Both of these patents describe cumbersome mechanical clockwork systems for compensating for changes in longitude and are relevant only to the extent that such changes are also due to differences in time of sunrise. Neither of these references describes a portable timepiece which compensates for seasonal changes in time of sunrise in a fixed geographic location so as to enable a user or a community of users to operate according to time of sunrise.

SUMMARY OF THE INVENTION

It is an object of the invention to provide a portable, electronic timepiece which automatically compensates for seasonal changes in time of sunrise.

According to the invention there is provided an electronic sunrise-dependent timepiece, comprising:

- an oscillator circuit for generating clock pulses at a predetermined frequency,
- a clock circuit coupled to the oscillator circuit for generating minutes and hours and calendar data,
- an offset correction circuit coupled to the clock circuit and being responsive to a current value of calendar data for adding a respective offset to the minutes and hours data so as to generate a sunrise-dependent time of day, and
- a display circuit coupled to the clock circuit for displaying the sunrise-dependent time of day.

Preferably, the sunrise-dependent timepiece further includes a selector switch for selectably switching the offset correction circuit to the clock circuit so as to allow display of either an uncompensated time of day or the sunrise-dependent time of day.

Optionally, a set switch is coupled to the clock circuit for setting the calendar data to a desired value. This allows initialization of the timepiece by an end-user according to the actual date on which the timepiece is set and obviates the need for pre-calibration by the manufacturer.

Optionally, the offset correction circuit is adapted to extract the offset from a look-up table and add the offset to the minutes and hours data once daily at a predetermined time each day. However, the offset may be calculated using a pre-programmed function and adjustment can be performed at other fixed time intervals, e.g. once weekly if desired.

BRIEF DESCRIPTION OF THE DRAWINGS

In order to understand the invention and to see how it may be carried out in practice, a preferred embodiment will now be described, by way of non-limiting example only, with reference to the accompanying drawings, in which.

DETAILED DESCRIPTION OF A PREFERRED EMBODIMENT

Figure 1:
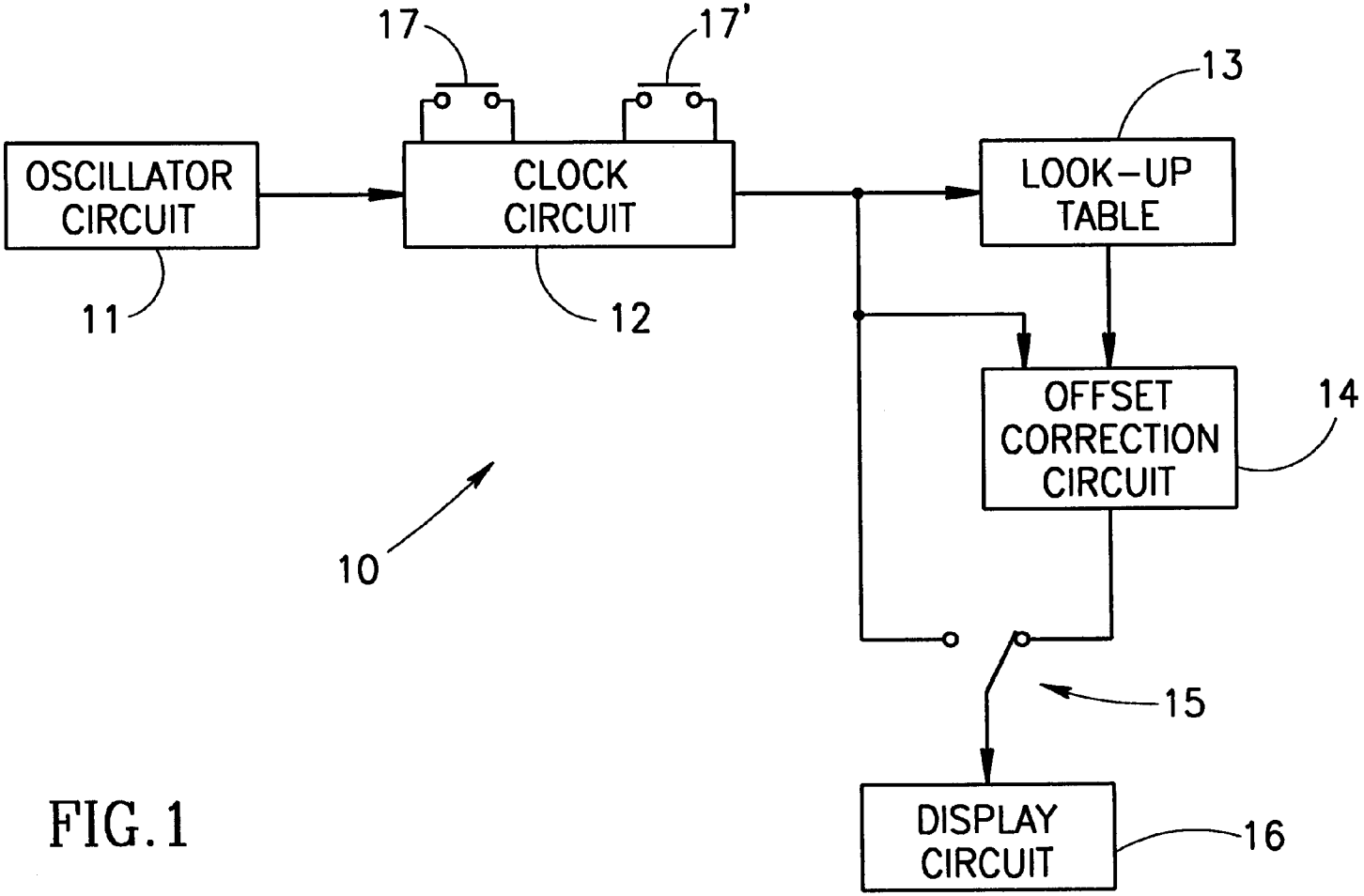
FIG. 1 is a block diagram showing functionally an electronic sunrise-dependent timepiece according to a first embodiment of the invention.

FIG. 1 shows functionally an electronic timepiece depicted generally as 10 comprising an oscillator circuit 11 for generating clock pulses at a predetermined frequency. A clock circuit 12 is coupled to the oscillator circuit 11 for generating minutes and hours and calendar data. The oscillator circuit 11 may employ a quartz crystal and may be integrated with the clock circuit 12 as a single component, in known manner. Coupled to the clock circuit is a look-up table 13 for storing respective offsets to be added to the minutes and hours data depending on a pre-calculated time of sunrise at a range of calendar data. An offset correction circuit 14 is selectably coupled to both the clock circuit 12 and the look-up table 13 by means of a selector switch 15 and is responsive to a current value of calendar data at a predetermined time period for adding a respective offset to the hours and minutes data so as to generate a sunrise-dependent time of day, and a display circuit 16 is coupled to the clock circuit 12 for displaying the sunrise-dependent time of day. The display circuit 16 may comprise a digital or analog display module connected to a suitable driver.

The selector switch 15 allows the offset correction circuit to be selectably switched to the clock circuit so as to allow display of either an uncompensated time of day or the sunrise-dependent time of day, as required. A pair of set switches 17 and 17' are also coupled to the clock circuit 12 for setting the time and calendar data to a desired value, thereby allowing initialization of the timepiece by an end-user according to the actual date on which the timepiece is set and obviating the need for pre-calibration by the manufacturer. Typically, the set-switches 17 and 17' are standard functions of an integrated clock circuit.

In such an arrangement, the look-up table 13 stores a cumulative offset for each addressable calendar date and the offset correction circuit 14 is thus adapted to add the cumulative offset to the minutes and hours data. As a result, the selector switch 15 allows the displayed time to be toggled between regular time and sunrise-compensated time, as required.

Figure 2:
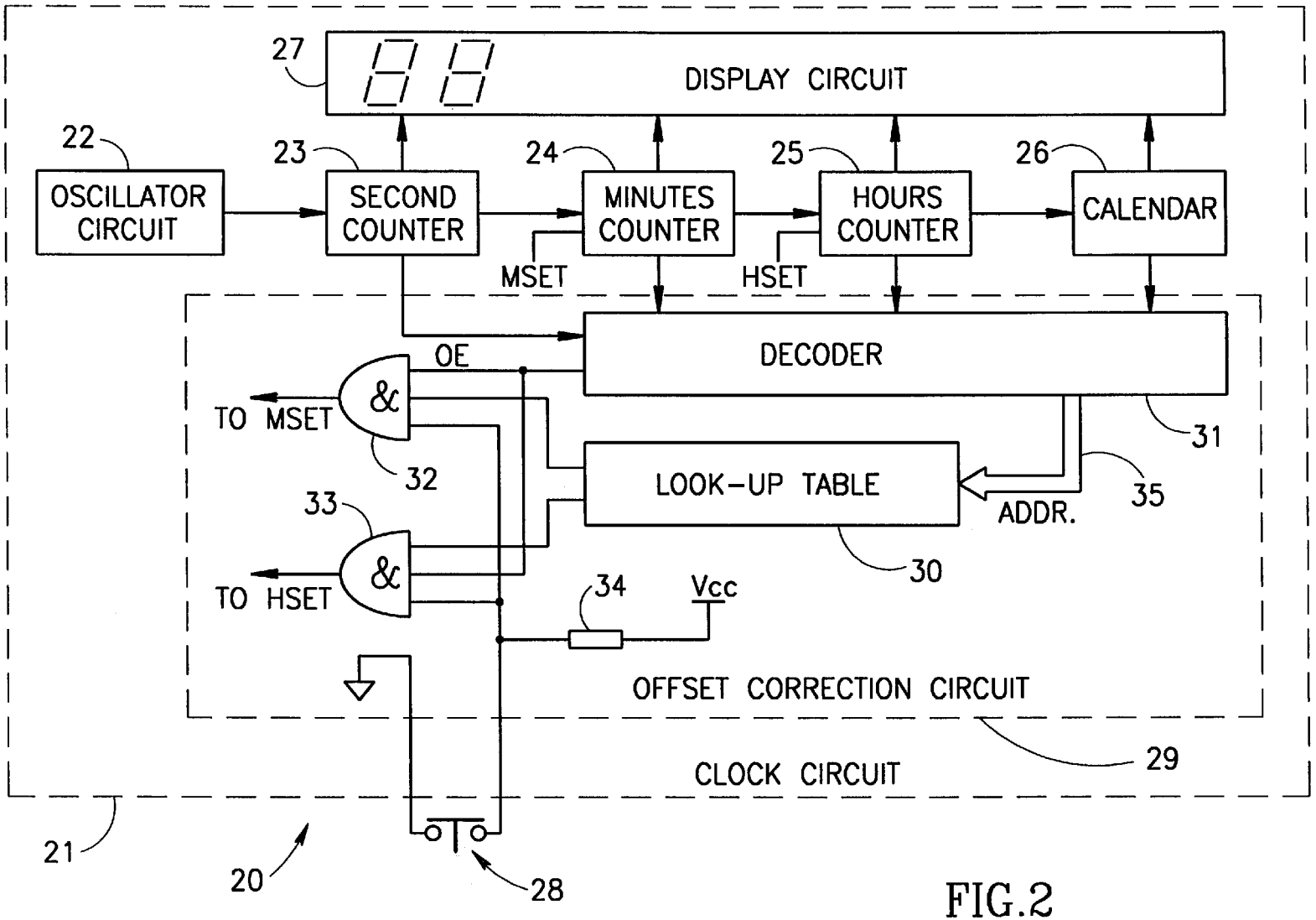
FIG. 2 is a block diagram showing functionally an electronic sunrise-dependent timepiece according to a second embodiment of the invention.

FIG. 2 shows functionally an electronic timepiece depicted generally as 20 comprising a clock circuit 21 containing an integral oscillator circuit 22 for generating clock pulses at a predetermined frequency. The oscillator circuit 22 is coupled to a seconds counter 23, to a minutes counter 24 and to an hours counter 25 for generating seconds, minutes and hours data, respectively. The hours data is, in turn, coupled to a calendar 26 for generating calendar data. The seconds counter 23, minutes counter 24 and hours counter 25 as well as the calendar 26 are coupled to a display circuit 27 typically being a LCD for displaying time and date digitally by means of 7-segment displays. However, an analog display may also be employed using a suitable driver. The date and time may be set remotely by means of suitable set switches (not shown) coupled to the clock circuit 21.

Selectably coupled to the minutes counter 24 and hours counter 25 by means of a selector switch 28 is an offset correction circuit 29 for adding respective incremental offsets to the minutes and hours data, respectively, depending on a pre-calculated time of sunrise at a range of calendar data stored in a look-up table 30. A decoder 31 is coupled to the seconds counter 23, the minutes counter 24 and to the hours counter 25 for generating an offset enable signal OE at an output thereof at a pre-programmed time of day. Optionally the decoder 31 may also be coupled to the calendar 26 in order that the enable signal OE be produced on specified dates or days only, and not every day. The output of the look-up table 30 is fed to respective inputs of a pair of AND gates 32 and 33 having inputs connected to the output of the decoder 31 and also to one pole of the selector switch 28 which is connected to the positive power supply Vcc via a suitable pull-up resistor 34. The other pole of the selector switch 28 is connected to GND. An address bus 35 connects the look-up table 30 to the decoder 31 so as to allow the appropriate entry in the look-up table to be read for a specific calendar date.

The offset correction circuit 29 operates as follows. When the selector switch 28 is closed, logic "0" is fed to the AND gates 32 and 33. Consequently, their outputs are logic "0" regardless of the output of the decoder 31. However, when the enable signal OE at the decoder output is logic "1" and the selector switch 28 is opened, the digital incremental offsets in the look-up table 30 for the current time period are fed by the AND gates 32 and 33 to the minutes and hours counters 24 and 25, respectively by MSET and HSET so as to increment their respective counts by the appropriate minutes and hours offsets. By such means, for so long as the selector switch 28 remains open, appropriate increments are added to the minutes and hours counters 24 and 25 at each pre-programmed time period and a sunrise-dependent time of day is displayed by the display circuit.

If the selector switch 28 is now closed, logic "0" is again fed to the AND gates 32 and 33, thereby disabling the offset correction circuit 29. However, unlike the first embodiment shown in FIG. 1, the time shown on the display circuit 27 does not automatically return to the regular time since, in this case, the minutes and hours counters 24 and 25 are irreversibly incremented by the offset correction circuit 29. Therefore, the timepiece 20 must be manually reset using the set switches (not shown) coupled to the clock circuit 21 if regular time is required. The set switches also allow the calendar data to be set to a desired value, thereby allowing initialization of the timepiece by an end-user according to the actual date on which the timepiece is set and obviating the need for pre-calibration by the manufacturer.

The timepiece 20 shown in FIG. 2 thus differs from the timepiece 10 shown in FIG. 1 in several ways. In the second embodiment, the offset correction circuit 29 is adapted to add the offset to the minutes and hours counters 24 and 25 at a predetermined time of day either daily or at any other pre-programmed time period. For example, if the predetermined time of day when the adjustment is effected is 3:00 and on a particular date the required adjustment is +2', 42" then the displayed time would change from 2:59:59 to 3:02:42. Such a small difference occurring when most users are asleep would, of course, cause no disturbance to the end-user. Associated with this, the offsets stored in the look-up table 13 shown in FIG. 1 are cumulative offsets which are added to the current time of day prior to display. In contrast, the offsets stored in the look-up table 30 shown in FIG. 2 are incremental and are added to the minutes and hours counters 24 and 25. Therefore, once sunrise time is enabled, the minutes and hours counters 24 and 25 are constantly incrementally adjusted and therefore not amenable to toggling between regular and sunrise time.

The use of incremental offsets in the second embodiment further leads to the storage in the look-up table of small changes which may therefore be accurate to within several seconds when the adjustment is made to the seconds counter 23 and the minutes counter 24 instead of to the minutes counter 24 and the hours counter 25. For such accuracy using cumulative offsets much greater memory capacity would be required.

Likewise, in the first embodiment, there is no fixed time when adjustment is made since this is user-dependent. However, in the second embodiment shown in FIG. 2, adjustment is effected at a fixed time of day (constituting the adjustment time) which is typically set during manufacture but could feasibly be set by the end-user using the set-switches.

Figure 3:
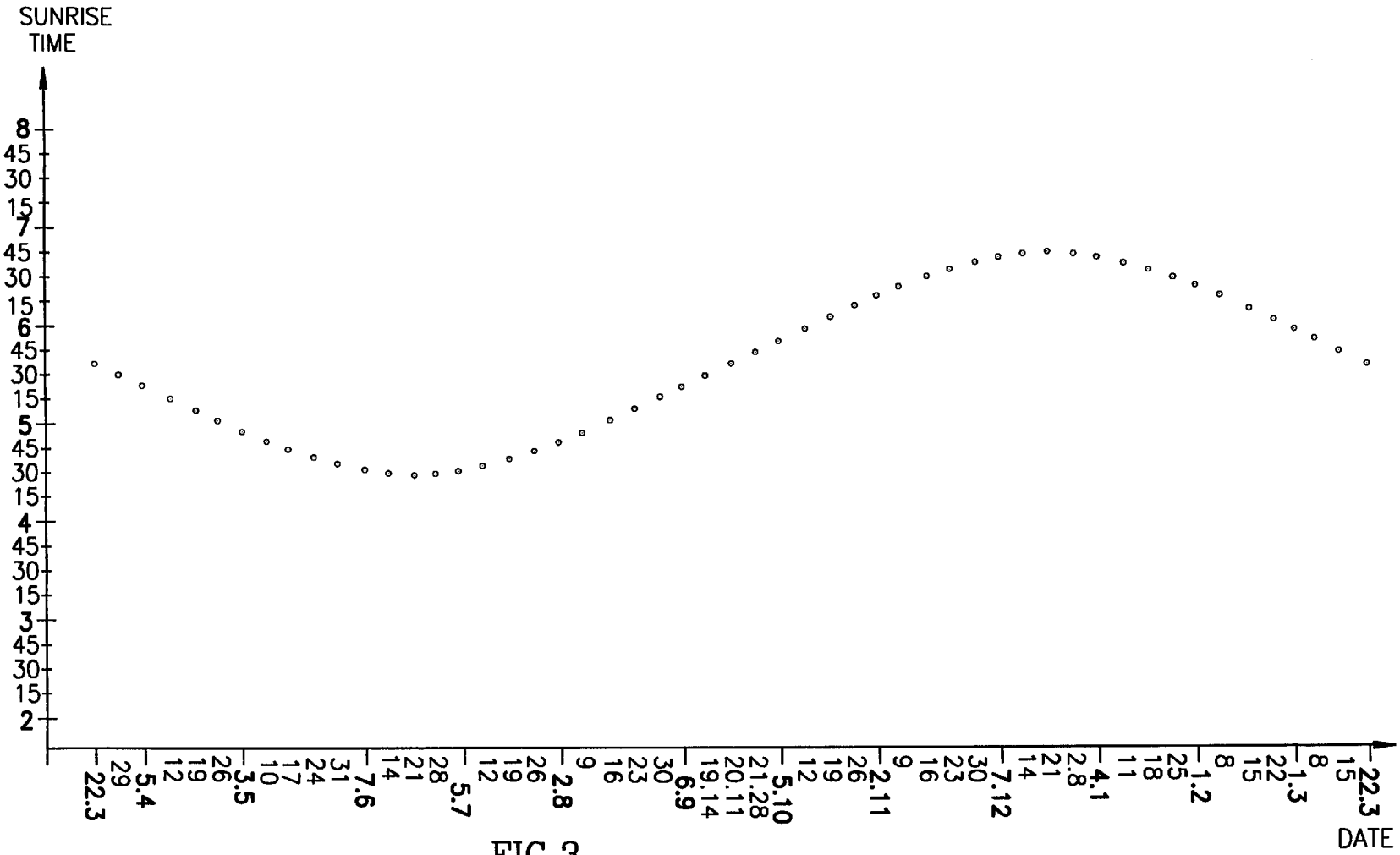
FIG. 3 shows graphically seasonal sunrise data which is stored as a series of offsets in a look-up table within the timepiece.

FIG. 3 shows graphically seasonal sunrise data for Israel which is stored as a series of offsets in the look-up table 13. Thus, for each calendar date shown on the x-axis, a corresponding positive or negative offset shown on the y-axis is stored in the look-up table 13. In use, the clock circuit 12 produces data indicative of the current date (constituting calendar data), which serves as the address to the look-up table 13 or 30. By such means, the required offset is derived and added to the time data generated by the clock circuit 12 prior to display. It will be understood that sunrise data is dependent on latitude and therefore changes from one country to another and even within the same country. If desired, multiple look-up tables can be provided so as to adapt the timepiece for use at different geographic locations.

The sunrise data shown in FIG. 3 is shown approximately for weekly time intervals. In reality, it will be appreciated that the graph is cyclical and repeatable so that, for example, the sunrise times at the two end-points, both of which show the sunrise times at March 22, must be identical. The actual data stored in the look-up table 13 or 30 may, of course, have higher resolution, for example based on daily variations in sunrise time. Alternatively, the sunrise time for a particular calendar date may be derived by interpolating between the two entries in the look-up table corresponding to the two dates closest thereto. This allows high accuracy whilst obviating the need for high resolution requiring a correspondingly large memory.

It should be noted that the internal structure of the look-up tables is different in the two embodiments. In the look-up table 13 shown in FIG. 1, cumulative offsets are stored each corresponding to the required absolute offset for the corresponding time period. As may be seen from the curve shown in FIG. 3, their nominal values get progressively larger until mid-winter and then decrease so as to reach a minimum at mid-summer. The offsets are preferably stored relative to an average DC level such that they are positive in summer and negative in winter. However, in the look-up table 30 shown in FIG. 2, incremental offsets are stored each relative to the previous offset. Thus, from mid-summer until mid-winter the incremental offsets are negative and change to positive from mid-winter until mid-summer, their magnitudes being fairly constant and small. As a result, each addressable memory location in the look-up table 13 must be able to store higher values than those in the look-up table 30, thus requiring a larger memory and, as noted above, resulting in lower accuracy.

It will be appreciated that modifications may be made to the invention without departing from the scope thereof as defined in the appended claims. For example, in the second embodiment, instead of using a decoder to determine when to effect the adjustment, software can be embedded within the clock circuit 21.

Likewise, the adjustment time can be stored in a separate memory module or could be encoded using other encoding means, such as suitable logic elements or switches, all as is well known in the art.

It will further be appreciated that whilst, as described, the adjustment is made when the offset enable goes HIGH, this is merely a design choice and the required adjustment could equally well be made LOW enable.

Finally, whilst a look-up table is used in the preferred embodiments, it will be appreciated that the required offsets can be calculated based on current calendar data using a suitable pre-programmed function.

What is claimed is:

1. An electronic sunrise-dependent timepiece, comprising:

an oscillator circuit for generating clock pulses at a predetermined frequency, a clock circuit coupled to the oscillator circuit for generating minutes and hours and calendar data, an offset correction circuit that includes a look-up table storing respective offsets to be added to the hours and minutes data depending on a pre-calculated time of sunrise at a range of calendar data, the offset correction circuit being coupled to the clock circuit for deriving the respective offset from the look-up table and adding the respective offset to the minutes and hours data so as to generate a sunrise-dependent time of day, and a display circuit coupled to the clock circuit for displaying the sunrise-dependent time of day, wherein the offset derived by the offset correction circuit is an incremental offset that is fixedly added to a currently displayed sunrise-dependent time at predetermined time intervals.

2. The sunrise-dependent timepiece according to claim 1, further including a set switch coupled to the clock circuit for setting the calendar data to a desired value.

3. The sunrise-dependent timepiece according to claim 1, wherein the offset correction circuit is adapted to add the offset to the minutes and hours data at a predetermined time of day at specified time periods.

4. The sunrise-dependent timepiece according to claim 1 wherein the offset correction circuit further includes an encoding means for encoding an adjustment time based on a predetermined time for effecting the offset correction and a specific time period, and a decoder coupled to the clock circuit for comparing the clock data with the adjustment time;

the offset correction circuit being responsive to an output from the decoder changing from a first level to a second level, for adding to an respective offset to the clock data.

* * * * *